US006349503B1

(12) United States Patent
Gompertz et al.

(10) Patent No.: US 6,349,503 B1
(45) Date of Patent: Feb. 26, 2002

(54) FLUID POWERED BARRIER SYSTEM

(75) Inventors: Michael A. Gompertz, Orinda; Klaus Silbermann, Sunol; Arthur B. Dawson, San Ramon, all of CA (US)

(73) Assignee: IJOT Development, Inc., Oakland, CA (US)

( * ) Notice: Subject to any disclaimer, the term of this patent is extended or adjusted under 35 U.S.C. 154(b) by 0 days.

(21) Appl. No.: 09/442,575

(22) Filed: Nov. 18, 1999

(51) Int. Cl.[7] ..... E01F 13/00
(52) U.S. Cl. ..... 49/34; 49/49
(58) Field of Search ..... 49/34, 49; 160/328, 160/329

(56) References Cited

U.S. PATENT DOCUMENTS

| | | | | |
|---|---|---|---|---|
| 334,801 | A | | 1/1886 | Parrish |
| 760,030 | A | | 5/1904 | Smith |
| 923,494 | A | | 6/1909 | Cummings |
| 1,468,471 | A | | 9/1923 | Harsen |
| 1,481,044 | A | | 1/1924 | Ware |
| 1,529,744 | A | | 3/1925 | Keenan |
| 1,642,875 | A | | 9/1927 | Fitch et al. |
| 1,643,297 | A | | 9/1927 | Fitch et al. |
| 1,665,157 | A | | 4/1928 | Dahnke |
| 1,790,304 | A | | 1/1931 | House |
| 1,987,913 | A | | 1/1935 | Schulz ..... 292/264 |
| 2,170,467 | A | | 8/1939 | Anderson ..... 246/126 |
| 2,298,115 | A | | 10/1942 | Feltone et al. ..... 24/68 |
| 2,527,866 | A | | 10/1950 | Welch ..... 296/57 |
| 2,605,829 | A | | 8/1952 | Sawyer ..... 160/328 |
| 2,662,571 | A | | 12/1953 | Kessler ..... 151/41.76 |
| 2,827,265 | A | | 3/1958 | McKillop ..... 256/41 |
| 2,919,895 | A | | 1/1960 | Johnson ..... 254/78 |
| 3,022,590 | A | | 2/1962 | Ohlhausen ..... 39/5 |
| 3,893,724 | A | | 7/1975 | Reinfeld ..... 292/247 |
| 4,108,405 | A | | 8/1978 | Gibson ..... 246/125 |
| 4,151,900 | A | | 5/1979 | Kirwan ..... 188/174 |
| 4,174,119 | A | | 11/1979 | Biles ..... 280/179 |
| 4,333,268 | A | | 6/1982 | Dumbeck ..... 49/34 |
| 4,509,577 | A | | 4/1985 | Priefert ..... 160/328 |
| 4,553,739 | A | | 11/1985 | Baines ..... 256/23 |
| 4,658,543 | A | * | 4/1987 | Carr ..... 49/49 X |
| 5,136,810 | A | * | 8/1992 | DeWitt ..... 49/49 |
| 5,245,787 | A | | 9/1993 | Swenson ..... 49/34 |
| 5,452,542 | A | | 9/1995 | Bardwell ..... 49/34 |
| 5,537,778 | A | | 7/1996 | Bardwell et al. ..... 49/34 |
| 5,871,038 | A | | 2/1999 | Gompertz et al. ..... 160/328 |

FOREIGN PATENT DOCUMENTS

| | | | | |
|---|---|---|---|---|
| DE | 1926385 | * | 11/1970 | ..... 49/34 |
| GB | 2239476 | * | 7/1991 | ..... 49/34 |
| WO | 94125683 | * | 11/1994 | ..... 49/34 |

* cited by examiner

*Primary Examiner*—Jerry Redman
(74) *Attorney, Agent, or Firm*—Medlen & Carroll, LLP

(57) ABSTRACT

A flexible barrier system is described that can be lowered or raised from a remote location using an accompanying remote control device which is either lockable or not lockable. The motor and mechanics used to raise and lower the chain are modular for easy repair and replacement, and enclosed in a protective covering in order to protect them from damage or tampering.

25 Claims, 5 Drawing Sheets

FLUID POWERED BARRIER SYSTEM

FIELD OF THE INVENTION

This invention relates to the field of gates and mechanical barriers which prevent passage through an opening. More specifically, this invention relates to the field of gates and mechanical barriers which are opened and closed by electric motors, compressed fluids or gases.

BACKGROUND OF THE INVENTION

A chain gate generally stretches across a driveway, road or passageway in order to block the travel of unwanted persons or vehicular traffic onto that driveway, road or passageway. The gate is usually attached to one post on either side of the driveway or road and stretched across and hooked, and/or locked to a post on the other side of the driveway or road. In the past the chain has been stretched across the driveway manually. A person who wanted to drive their vehicle through the chain gate or a gate-like barrier would have to get out of their vehicle, unhook the chain from the fence post or gate and then drive through the gate posts or opening. To close the chain gate or gate-like barrier, the person would again have to get out of their vehicle and hook the chain back up to the post. During inclimate weather this procedure can be very demanding as a person wishing to travel through the chain gate or gate-like barrier will be exposed to the bad weather conditions both in opening and closing the gate.

An early gate of this form is presented by J. S. Fitch et al. in U.S. Pat. No. 1,643,297. The gate structure 10 as disclosed by this patent is fixedly connected to the gate post 11. This gate structure is lowered and raised manually by pulling the cable 35 which releases and engages the arm 22 with the hook 24. When the gate structure is lowered it rests on the ground between the posts so that a vehicle driving through the gate will drive over the chain.

Another gate locking device of this type is presented by Reinfeld in U.S. Pat. No. 3,893,724. The gate 4 is connected between the stationary fence post 26 and the movable fence post 24. The movable fence post 24 is locked to another stationary fence post 2 by a locking device 1. The locking device has an arm 9 which has a flexible member 10 which connects over the top of the movable fence post 24 to lock the gate in the closed position. When the gate is opened, the flexible member 10 is manually unhooked from the top of the movable fence post 24, lifted out of the ring 28 and the gate structure is then carried to the opposite side of the road or driveway thus clearing the gate from the road or driveway. When the gate is to be closed, the gate structure has to be manually carried across the road or driveway, the bottom of the fence post 27 has to be slipped into the ring 28 at the bottom, the flexible member 10 is slipped over the top of the fence post 24 and the locking device 1 is then secured in the locked position.

A solar-powered electrically controlled gate is presented by Dumbeck in U.S. Pat. No. 4,333,268. The chain 10 is fixedly connected to the post 11 and is coupled to the pivoted lever 14 which is connected to the opposite post 12. The chain 10 is raised and lowered by the two pivoted levers 14,15 and the drive motor 16. The motor has a worm drive train 17 and a pivoting gear 18. The lever 15 is moved downward to relax the chain 10 and open the gate and the lever 15 is moved upward to tighten the chain 10 and close the gate. The operation of this gate is controlled by manual operation of the corresponding switch 42,43.

What is needed is a barrier system which can be mechanically opened and closed by a user with a remote control device so that the user will not have to get out of their vehicle at any time to open or close the gate and can also open or close the gate from a long distance away, thus giving a homeowner great protection or control, where the driveway may be a great distance from their home.

SUMMARY OF INVENTION

The mechanical barrier system of the present invention has a fluid-based ("fluid" defined herein as any compressible liquid or gas composition) operating mechanism. The barrier can be lowered or raised from a remote location using an accompanying remote control device. The mechanics used to raise and lower the chain are modular for easy repair and replacement, and enclosed in a protective covering in order to protect them from damage or tampering. The motor (which can be internal or external to the covering) can be operated by alternating current or direct current to provide the user with flexibility and allow operation of the gate by direct wire to an electrical source, one or more batteries, or rechargeable solar cells for use in remote places where there is no access to electrical power.

In one embodiment, the present invention contemplates a barrier system, comprising: a) a barrier linking a first stationary object to a second stationary object, b) a means for raising and lowering said barrier, said means coupled to said barrier and comprising; i) a cylinder, and ii) a motor operably linked to (that is to say, attached or in communication with) said cylinder such that said cylinder moves when said motor operates, and iii) a traveling roller assembly configured such that it moves up and down when said cylinder moves, said traveling roller assembly comprising a roller that engages said barrier. It is not intended that the present invention be limited to the precise means for raising and lowering said barrier, however, it is desired that it be enclosed within said first stationary object. It is not intended that the present invention be limited by the nature of the cover or enclosure used to house the mechanics of the system; in one embodiment said first stationary object is selected from a group of hollow post, hollow column, hollow pillar, and hollow wall. It is convenient to extend the length or height of the barrier for particular applications; in one embodiment, additional internal pulleys and second chain members extend the length and/or height of said barrier. A variety of barrier types can be used with this embodiment; for example, said barrier can comprise a chain which hangs between said first stationary object and said second stationary object.

The present invention, while utilizing a cylinder, is not limited to the precise type (e.g. the cylinder may be hydraulic or other type) or particular placement of the cylinder; in one embodiment, said cylinder has top and bottom ends, and connecting rods connecting both ends to comprise an internal mechanism framework to which said bottom end is secured to the external supporting structure weldmount flanges. In one embodiment, a motor is operably linked to said cylinder by use of a fluid pumping device. In another embodiment, a motor is operably linked to said cylinder by use of a device delivering compressed air.

The present invention also contemplates a barrier system, comprising: a) a barrier linking a first stationary object to a second stationary object, b)a mechanism for raising and lowering said barrier, said mechanism enclosed within said first stationary object and coupled to said barrier, said mechanism comprising; i)a hydraulic cylinder, and ii)a motor operably linked to said hydraulic cylinder such that said hydraulic cylinder moves when said motor operates, and iii) a traveling roller assembly configured such that it moves up and down when said hydraulic cylinder moves, said traveling roller assembly comprising a roller that engages said barrier. This embodiment is also conveniently enclosed within said first stationary object (e.g. a hollow post, hollow column, hollow pillar, hollow wall and the like). Again, the placement of the cylinder can vary; for example, said hydraulic cylinder can have top and bottom ends and said bottom end can be secured to a base plate mounted within said post. A variety of motors can be used in a variety of ways; in one embodiment said motor is operably linked to said hydraulic cylinder by use of a fluid pumping device. In another embodiment, said motor is operably linked to said hydraulic cylinder by use of a device delivering compressed air.

The present invention also contemplates a barrier system, comprising: a) a barrier linking a first stationary object to a second stationary object, b) a mechanism for raising and lowering said barrier enclosed within said first stationary object, said mechanism first stationary object and coupled to said barrier, said mechanism comprising; i) a hydraulic cylinder, and ii) a motor operably linked to said hydraulic cylinder such that said hydraulic cylinder moves when said motor operates, iii) a traveling roller assembly configured such that it moves when said hydraulic pump moves, said traveling roller assembly comprising a roller that engages said barrier.

In one embodiment, the barrier is moved by means of a hydraulic cylinder capable of holding air, inert gases, or any fluid. The movement of the hydraulic cylinder can reel in and out any flexible barrier across a passage way, or to fill in, or fill up, a vacant area. When the flexible barrier is in the down position it allows passage through, or use of, an area. However, when the flexible barrier is in the up position it blocks passage through, or use of, that area. The flexible barrier material can be chain, rope, cable, netting, chain link fencing, a rigid fence or gate attached to the middle of the flexible components, and any other flexible material (including plastic or rubber).

The compressed fluid design has inherent appeal because of (among other things): (1) purchaser preference; (2) inexpensive cost; (3) few moving parts (for example, in one specific embodiment, the device comprises, a) the hydraulic cylinder, b) the lower roller or sprocket, c) the traveling roller assembly, d) the second chain member, and e) the upper external roller) allowing easier assembly and less potential for future repair; (4) greater manufacturing flexibility by changing the size or stroke of the hydraulic cylinder to allow a variety of embodiments or applications for specific uses; (5) fast manufacturing due to the simple design; (6) lightweight for inexpensive and efficient handling and shipping; (7) reductions in size and structure of the entire mechanism for very-light flexible barriers (e.g. one contemplated embodiment uses a smaller post or space for the mechanism); and (8) virtual silence offering numerous benefits for the residential and industrial markets.

One embodiment (as noted above) uses a hydraulic cylinder to raise or lower a chain or flexible barrier material to control entry through a passageway. The mechanism resides inside a structure which is comprised of said cylinder, a chain, and a pulley mechanism connected to the flexible barrier. This mechanism is a modular unit that can slip inside a supporting outer structure such as a pipe, post, pilar, cement or stone structure having either purely functional or architecturally aesthetic decorative characteristics. The cylinder can be powered by a variety of voltage electrical sources (i.e., standard 110 AC, a 12 volt, 24 volt, or automobile battery). A specific advantage of the automobile battery embodiment is that it can be trickle-charged by means of a solar panel, wind generator or other such recharging device allowing use in remote areas.

DETAILED DESCRIPTION OF SPECIFIC EMBODIMENTS

Figure 1:
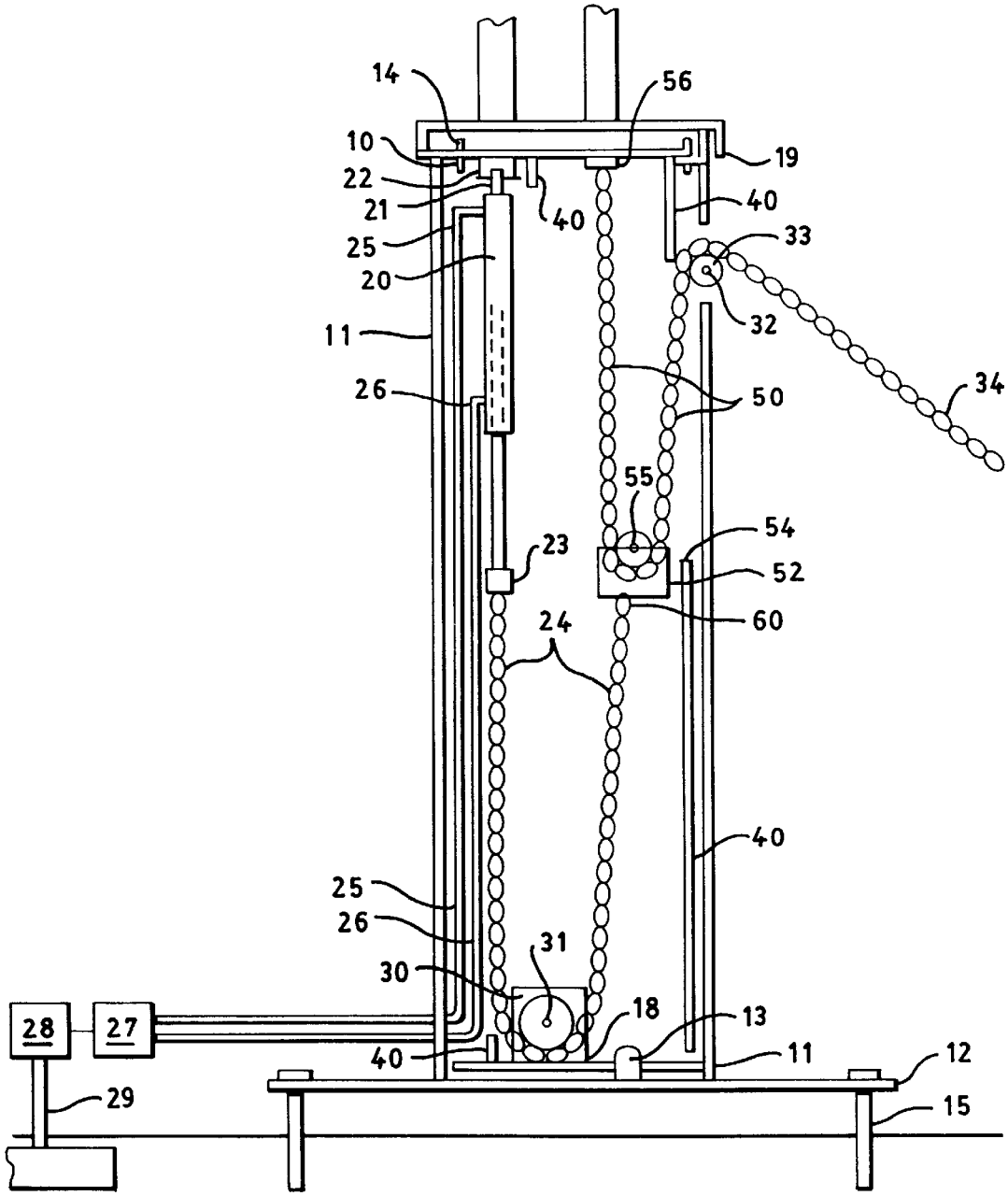
FIG. 1 is a side view of one embodiment of the barrier mechanism of the present invention.
Figure 2A:
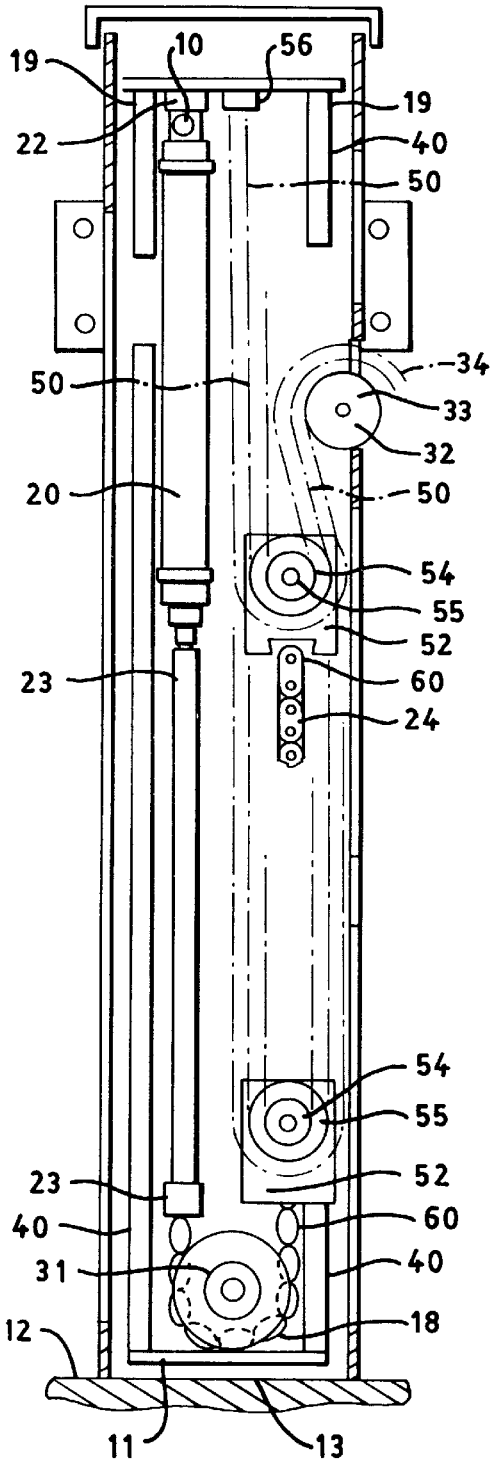
FIG. 2A is a cut-away side view of one embodiment of the barrier mechanism of the present invention.
Figure 2B:
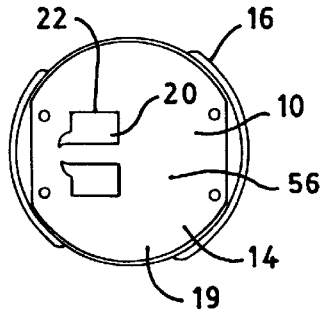
FIG. 2B is a top-view cross-section of the upper mechanisms chassis of one embodiment of the barrier mechanism of the present invention.
Figure 2C:
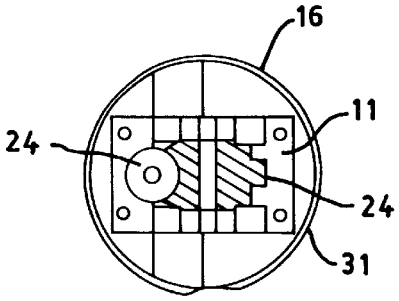
FIG. 2C is a top-view cross-section of the lower roller or sprocket assembly of one embodiment of the chain gate mechanism of the present invention.
Figure 3:
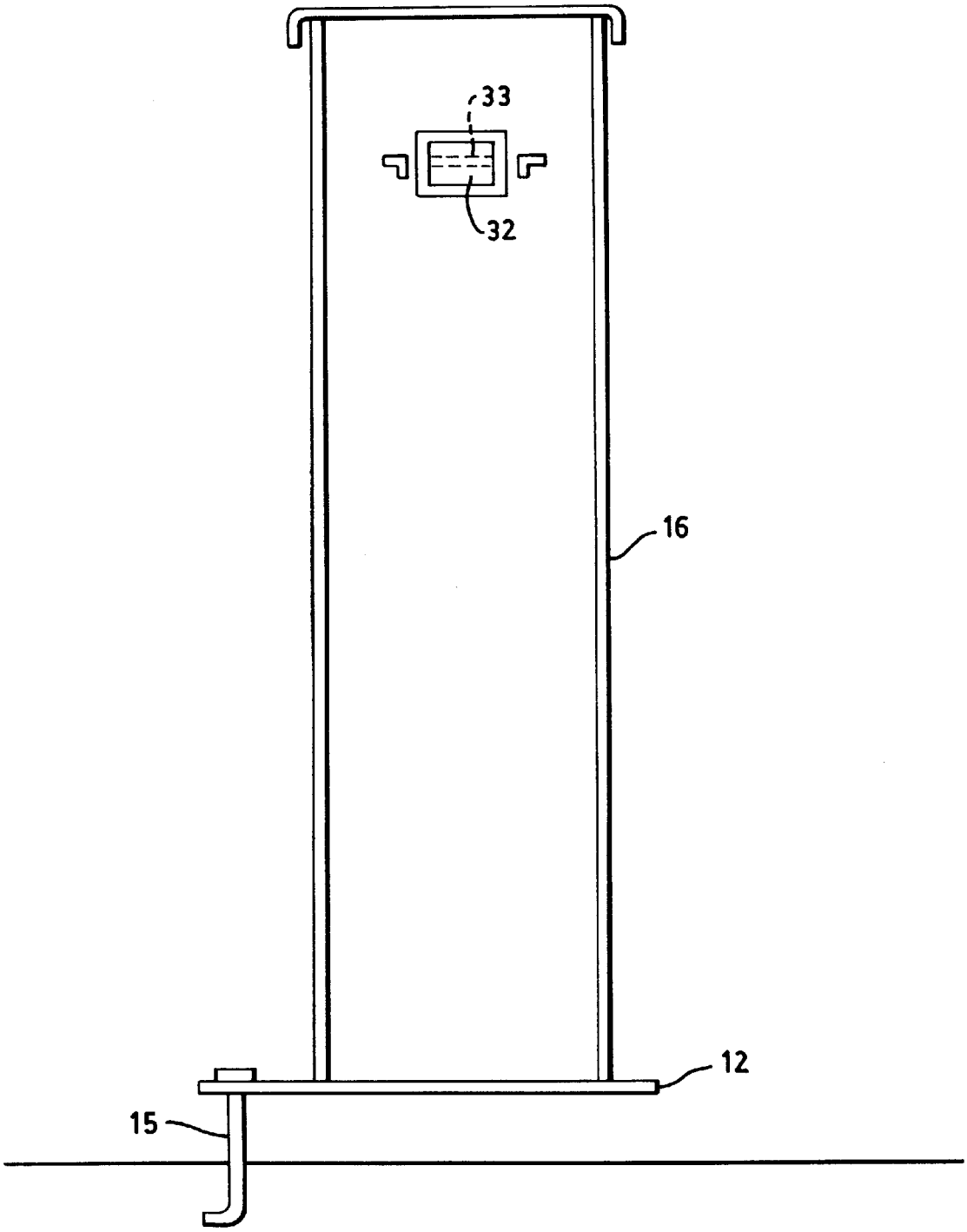
FIG. 3 is a front external view of one embodiment of the chain gate mechanism support structure or pipe of the present invention.

FIG. 1 clearly depicts the elements and operation of one embodiment the invention presented as a side view. It is comprised of a hydraulic cylinder 20, a top plate 10, and bottom plate 11 all connected together but held apart by four assembly comer support rods 40 thus forming a rigid modular frame structure. This structure holds and separates the hydraulic cylinder 20, a lower roller or sprocket 31, a second chain member 50, and a traveling roller assembly 52 allowing capture of the traveling roller 54, axle 55, swivel clevis pin 60, and second chain member fastening coupling pin 56 at the top plate 10, along with an upper external pulley 32 and the external chain or barrier material 34 which can be a continuation of the internal chain 50. The external supporting structure 16 (which encloses the mechanical elements) is illustrated as a pipe (FIG. 3) comprised of a bottom plate 12 welded to the bottom of the steel post structure 16 with an assembly locating pin 13 (FIG. 1) welded at the bottom of the external supporting bottom plate structure 12 (FIG. 1), which also serves as a bolt-down plate to which the external structure 16 is attached and using removable bolts 15 to secure the product to the foundation (FIG. 3) (if so desired). The internal framework, or mechanism framework, is secured to the external support structure by flange bolts 14 (FIG. 1) to the top flange supports 19 (FIGS. 1 & 2B).

In one embodiment, the hydraulic cylinder 20 is suspended from the bottom of the top plate 10 and hangs downward whereby when the hydraulic cylinder 20 Is activated or extended it releases the tension on the internal chain or flexible material 24 (FIG. 1). In the hydraulic cylinder embodiment, the preferred cylinder has a readily operable means to extend and retract the cylinder rod. The internal chain or flexible material 24 then wraps around a lower roller or sprocket 31 and travels up to a traveling roller assembly 52 which captures a traveling roller 54 and axle 55. The traveling roller assembly 52 controls and guides the ingress and egress of the second chain member 50 over the external pulley 32 as the traveling roller assembly 52 is pulled in or released out by the internal chain or flexible material 24 which is controlled by the direction of the cylinder rod of the cylinder 20 and determines the travel of the external flexible material 34 (FIG. 1). The external flexible material 34 can be the same or a different material as the internal flexible material 24 and/or the second chain member 50.

In one embodiment, the hydraulic cylinder 20 is suspended from the bottom side of the top plate 10 by a U-bracket clevis pin 22 (FIGS. 1 & 2A) which is welded or bolted to the top plate 10 and is attached to the hydraulic cylinder 20 fastening-end 21. The opposite end of the hydraulic cylinder 20 connects to the internal chain or flexible material 24 with a cylinder rod chain connector 23. The lower roller or sprocket 31 is held with a lower U-bracket clevis 30 which in turn is bolted to the bottom plate 11 through bearings and bearing support standoffs 18. The cylinder 20, by being attached to the top plate 10 which is attached to the top external supporting structure 16 by the weldmount pieces 19 enables the removal of the entire internal mechanism framework by the extraction of 4 bolts resulting in the exposure of all the parts for replacement or maintenance. In this manner, the cylinder can be quickly replaced.

The hydraulic cylinder 20 operates by means of a compressible fluid, air, or gas which is pumped from a reservoir 28 by pump 27 through one of two transmission lines 25 or 26 to opposite ends of the hydraulic cylinder. In one embodiment, the cylinders are hydraulic cylinders. In the preferred embodiment, the cylinders are pneumatic cylinders. The preferred hydraulic cylinder has internal fluid lines and by using alternative cylinders the stroke can be changed. Fluid may be admitted to the piston chamber in a variety of ways; 1) with a double port (intake and exhaust) design where the exhaust air goes to a storage reservoir before being pumped to the other end of the cylinder, 2) with a double port recirculating design operably linked with only a pump allowing direct transfer from one end of the cylinder to the other, or 3) a "rodless" cylinder where in lieu of a rod, an arm essentially extends from the piston plunger, out through a side slot, to which is attached the flexible barrier material 24. This embodiment requires less travel distance and less height of product. The pump 27 can be powered by means of either AC (alternating current) or DC (direct current, such as a battery) voltage electric sources, which can be trickle-charged by means of a solar panel, wind, hydrogenerator, or any other recharging device thus allowing operation of this embodiment in a remote area. The remote control logic boards (i.e., printed circuit, logic, and receiver) can be obtained commercially and located on standoffs, attached to top side of top chassis plate, and just under the cap (not shown). The hydraulic cylinder 20 can also be powered by air via an air pump, compressed air reservoir, compressor, or any other air supply mechanisms.

Figure 4:
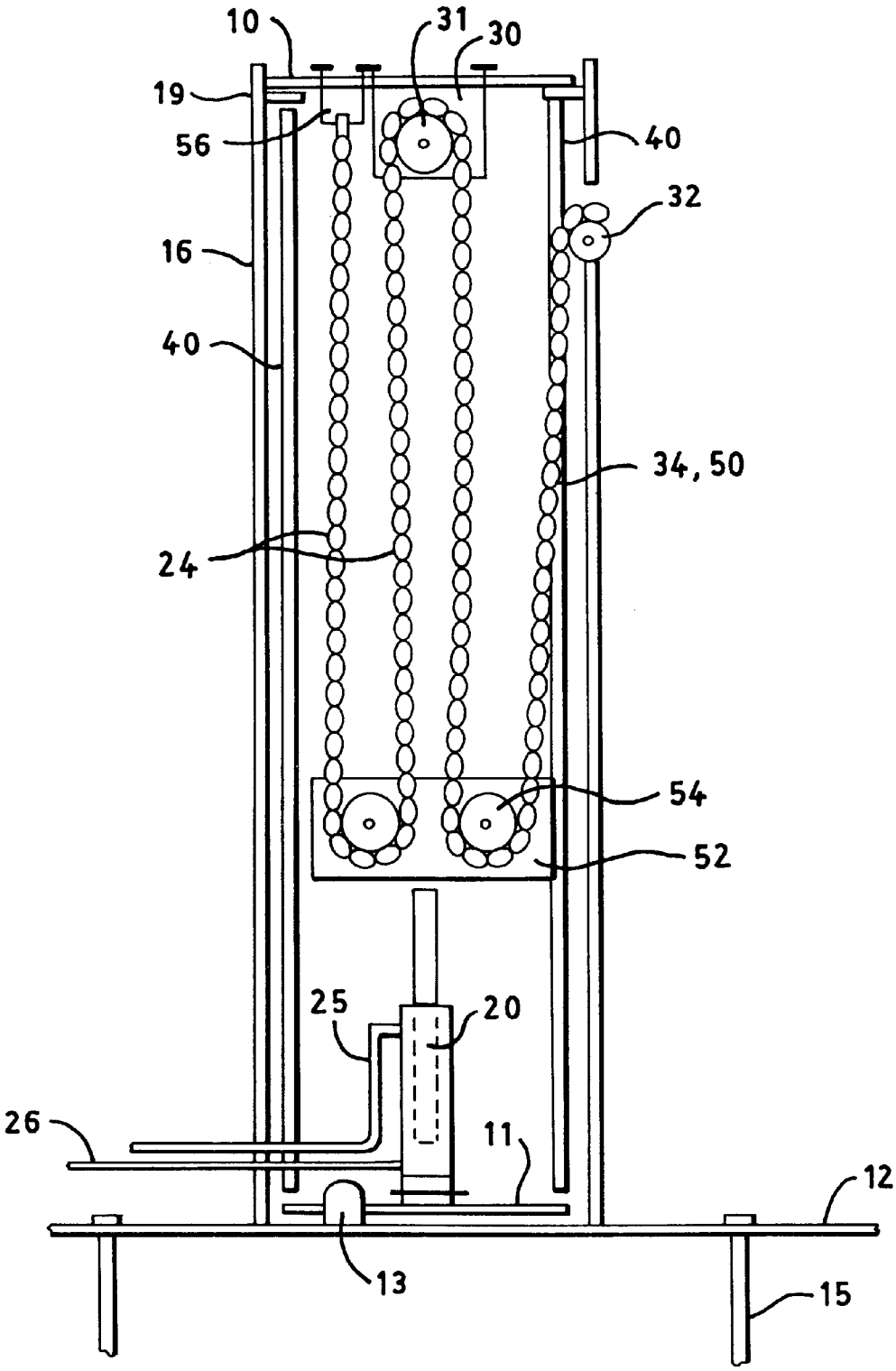
FIG. 4 is a cut-away side view of a modification of one embodiment of the chain gate mechanism of the present invention.

The description above has a minimal number of parts and numerous embodiments for different applications and should not be construed as limiting the scope of the invention but only as merely providing an illustration of one of the presently envisioned embodiments of this invention. Various other embodiments are possible within the spirit and scope of the present invention. For example, extending the length of chain or flexible material that stretches across an opening or extending the height of the posts and top chain (or flexible material) can be achieved by a rearrangement of the internal mechanism or by using a longer cylinder and rods. One such embodiment (FIG. 4) could be configured by attaching said cylinder 20 to the bottom plate rather than the top plate, and mounting two rollers 54 or sprockets on the end of the cylinder rod accompanied by one roller or sprocket on the bottom of the top plate effectively doubles, or in other alternative embodiments of the same idea, quadruples the amount or length of chain per distance of the cylinder rod stroke that can be released. This allows a longer barricade length using the same (or less) stroke of the cylinder rod. Conversely, by using a shorter stroke, a lower post (or colunn, etc.) can effectively barricade the same length. Then, by adding additional pulleys, rollers or sprockets, this shorter post or column can once again be able to span a barrier length provided by the original post height. For example, a six or seven or eight foot high netting across a roll up door opening is possible by changing the stroke, adding some pulleys, and using cable as the internal and top flexible materials 24, 34, & 50.

Alternative embodiments can set the invention inside a decorative pillar, cement or stone column, faux cement or faux stone column, decorative wooden structure, property fence wall, a building's wall structure, the entrance to a car port, or factory roll-up door entrance, etc. Alternative embodiments allow the flexible barricade to be as low or as high as the user desires limited only by the height or the configuration of the internal mechanism of the desired embodiment.

Figure 5B:
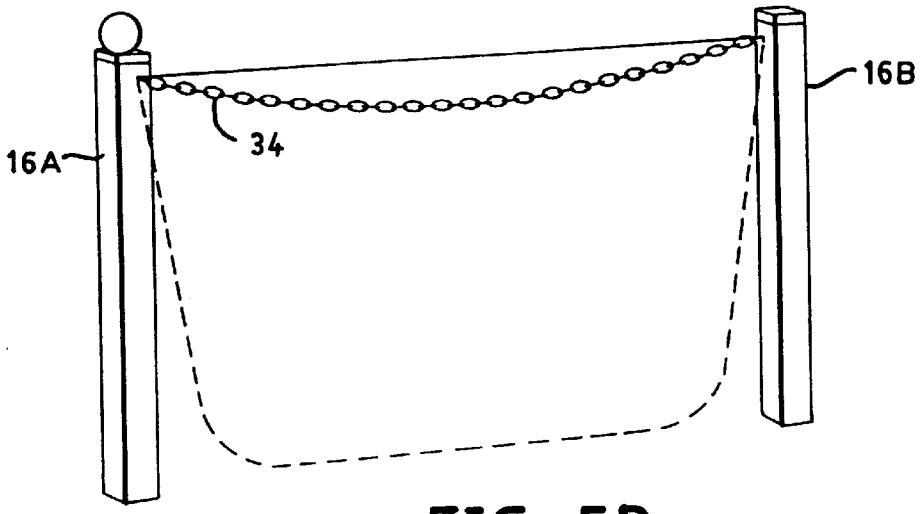
FIGS. 5A–C display three embodiments for a set of posts that support a flexible barrier
Figure 5A:
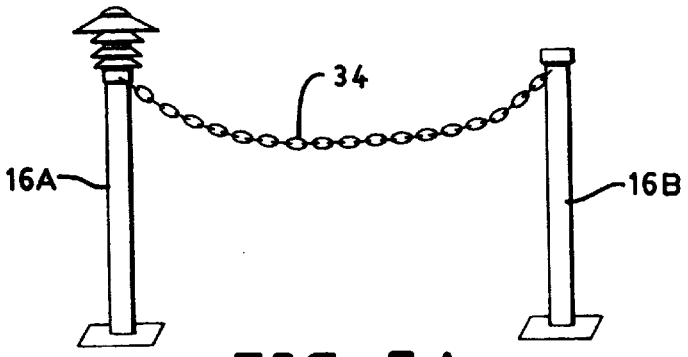
Figure 5C:
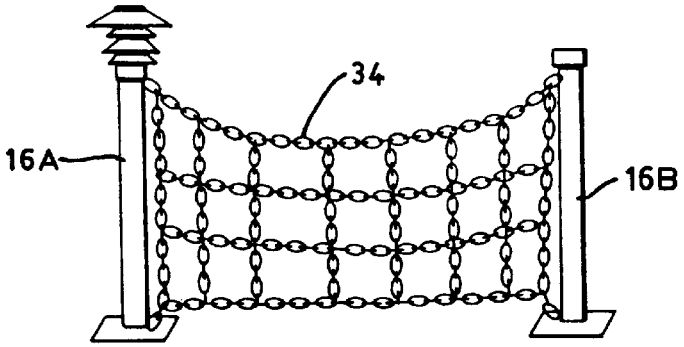

This invention offers numerous embodiments designed for applications and uses accommodating not only typical residential and commercial driveways but also the elevated height requirements found at rural properties, livestock pens, and factory entrances. For example, FIGS. 5A–C display 3 possible embodiments for a set of posts 16A & 16B that support a flexible barrier 34. One end of a top chain component 34 is secured to a stationary non-mechanized post, wall, building, or other structure (e.g., by means of padlock, bolt and nut or other first fastening means inside the post as the chain passes into the post) while the other end enters the cylinder mechanism described above.

From the above, it should be clear that the present invention offers high reliability at a low cost and low selling price, thus having considerable benefit for the public interest. Additionally, the assembly framework is easily removed in one piece, which, when removed from the external structure, exposes all of the attached components and provides easy access to each of them for purposes of repairing or replacing parts.

We claim:

1. A barrier system, comprising:

a) a barrier linking a first stationary object to a second stationary object, b) a means for raising and lowering said barrier, said means coupled to said barrier and comprising;

i) a cylinder, and ii) a motor operably linked to said cylinder such that said cylinder moves when said motor operates, and iii) a traveling roller assembly configured such that it moves up and down when said cylinder moves, said traveling roller assembly comprising a roller that engages said barrier, said traveling roller assembly configured such that a length of said barrier is reeled in and out in accordance with the movement of said cylinder.

2. The barrier system of claim 1, wherein said means for raising and lowering said barrier is enclosed within said first stationary object.

3. The barrier system of claim 2, wherein said first stationary object is selected from a group of hollow post, hollow column, hollow pillar, and hollow wall.

4. The barrier system of claim 3, wherein said cylinder has top and bottom ends, and connecting rods connecting both ends to comprise an internal mechanism framework to which said bottom end is secured within said first stationary object.

5. The barrier system of claim 1, wherein additional internal pulleys and second chain members extend the length and/or height of said barrier.

6. The barrier system of claim 1, wherein said motor is operably linked to said cylinder by use of a fluid pumping device.

7. The barrier system of claim 1, wherein said motor is operably linked to said cylinder by use of a device delivering compressed air.

8. The barrier system of claim 1, wherein said barrier comprises a chain which hangs between said first stationary object and said second stationary object.

9. The barrier system of claim 1, wherein said cylinder is hydraulic.

10. A barrier system, comprising:

a) a barrier linking a first stationary object to a second stationary object, b) a mechanism for raising and lowering said barrier, said mechanism enclosed within said first stationary object and coupled to said barrier, said mechanism comprising;

i) a hydraulic cylinder, and ii) a motor operably linked to said hydraulic cylinder such that said hydraulic cylinder moves when said motor operates, and iii) a traveling roller assembly configured such that it moves up and down when said hydraulic cylinder moves, said traveling roller assembly comprising a roller that engages said barrier, said traveling roller assembly configured such that a length of said barrier is reeled in and out in accordance with the movement of said cylinder.

11. The barrier system of claim 10, wherein said mechanism for raising and lowering said barrier is enclosed within said first stationary object.

12. The barrier system of claim 11, wherein said first stationary object is selected from a group of hollow post, hollow column, hollow pillar, and hollow wall.

13. The barrier system of claim 12, wherein said hydraulic cylinder has top and bottom ends and said bottom end is secured to a base plate mounted within said post.

14. The barrier system of claim 10, wherein additional internal pulleys and second chain members extend the length and/or height of said barrier.

15. The barrier system of claim 10, wherein said motor is operably linked to said hydraulic cylinder by use of a fluid pumping device.

16. The barrier system of claim 10, wherein said motor is operably linked to said hydraulic cylinder by use of a device delivering compressed air.

17. The barrier system of claim 10, wherein said barrier comprises a chain which hangs between said first stationary object and said second stationary object.

18. A barrier system, comprising:

a) a barrier linking a first stationary object to a second stationary object, b) a mechanism for raising and lowering said barrier, said mechanism first stationary object and coupled to said barrier, said mechanism comprising;

i) a hydraulic cylinder, and ii) a motor operably linked to said hydraulic cylinder such that said hydraulic cylinder moves when said motor operates, iii) a traveling roller assembly configured such that it moves when said hydraulic cylinder moves, said traveling roller assembly comprising a roller that engages said barrier, said traveling roller assembly configured such that a length of said barrier is reeled in and out in accordance with the movement of said cylinder.

19. The barrier system of claim 18, wherein said mechanism for raising and lowering said barrier is enclosed within said first stationary object.

20. The barrier system of claim 19, wherein said first stationary object is selected from a group of hollow post, hollow column, hollow pillar, and hollow wall.

21. The barrier system of claim 20, wherein said hydraulic cylinder has top and bottom ends and said bottom end is secured to a base plate mounted within said post.

22. The barrier system of claim 18, wherein additional internal pulleys and second chain members extend the length and/or height of said barrier.

23. The barrier system of claim 18, wherein said motor is operably linked to said hydraulic cylinder by use of a fluid pumping device.

24. The barrier system of claim 18, wherein said motor is operably linked to said hydraulic cylinder by use of a device delivering compressed air.

25. The barrier system of claim 18, wherein said barrier comprises a chain which hangs between said first stationary object and said second stationary object.

* * * * *